US008967268B2

(12) United States Patent
Urban et al.

(10) Patent No.: US 8,967,268 B2
(45) Date of Patent: Mar. 3, 2015

(54) SETTING SUBTERRANEAN TOOLS WITH FLOW GENERATED SHOCK WAVE

(75) Inventors: Larry J. Urban, Santa Fe, TX (US); Ronnie D. Russell, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 483 days.

(21) Appl. No.: 13/307,229

(22) Filed: Nov. 30, 2011

(65) Prior Publication Data

US 2013/0133878 A1 May 30, 2013

(51) Int. Cl.
*E21B 23/00* (2006.01)

(52) U.S. Cl.
USPC ..... 166/320; 166/323; 166/374; 166/334.4

(58) Field of Classification Search
CPC ..... E21B 23/00; E21B 23/04
USPC ..... 166/320, 323, 332.1, 332.6, 334.4, 374; 137/115.06, 115.08
See application file for complete search history.

(56) References Cited

U.S. PATENT DOCUMENTS

| | | | | | |
|---|---|---|---|---|---|
| 3,909,776 | A * | 9/1975 | Broding et al. | ..... | 181/119 |
| 4,054,399 | A * | 10/1977 | Maurer | ..... | 417/226 |
| 4,120,097 | A * | 10/1978 | Jeter | ..... | 33/307 |
| 4,905,778 | A * | 3/1990 | Jurgens | ..... | 175/232 |
| 5,079,750 | A * | 1/1992 | Scherbatskoy | ..... | 367/85 |
| 7,870,895 | B2 | 1/2011 | Lucas | | |
| 8,522,877 | B2 * | 9/2013 | Chambers et al. | ..... | 166/323 |
| 2005/0011678 | A1 * | 1/2005 | Akinlade et al. | ..... | 175/72 |
| 2012/0279603 | A1 * | 11/2012 | Swist | ..... | 138/109 |
| 2012/0327742 | A1 * | 12/2012 | Kusko et al. | ..... | 367/25 |
| 2014/0048283 | A1 * | 2/2014 | Mohon et al. | ..... | 166/374 |

* cited by examiner

*Primary Examiner* — Jennifer H Gay
*Assistant Examiner* — Steven MacDonald
(74) *Attorney, Agent, or Firm* — Steve Rosenblatt

(57) ABSTRACT

A circulation sub is provided that has a ball seat and a circulation port that is closed when a ball is landed on the seat. An axial passage directs the pressure surge created with the landing of the ball on the seat to the port with the actuation piston for the tool. The surge in pressure operates the actuation piston to set the tool, which is preferably a packer. Raising the circulation rate through a constriction in a circulation sub breaks a shear device and allows the restriction to shift to cover a circulation port. The pressure surge that ensues continues through the restriction to the actuating piston for the tool to set the tool.

22 Claims, 6 Drawing Sheets

SETTING SUBTERRANEAN TOOLS WITH FLOW GENERATED SHOCK WAVE

FIELD OF THE INVENTION

The field of the invention is a setting mechanism for subterranean tools and more particularly a mechanism to produce a flow induced pressure wave that is sufficient to set the tool.

BACKGROUND OF THE INVENTION

Tools located in very deep wells frequently need pressure levels for setting that can be beyond the capabilities of surface pumping equipment. One way to set such tools is to develop a boost force in the form of a pressure surge to get the internal pressure in the tool to a level where the tool can be set.

One attempt at doing this is illustrated in U.S. Pat. No. 7,870,895 where initial movement of the packer setting mechanism triggers either a chemical reaction that generates gas pressure or a setting off of explosive to get a pressure surge to set the packer. These two sources can be an assist or the sole driving force for setting the packer with a pressure sensitive piston. Generating the pressure surge with chemicals or explosives creates increased cost as well as safety issues and transportation issues to the well site.

What is needed is a simpler and cheaper way to generate a pressure surge to set a subterranean tool and the present invention addresses this issue. The kinetic energy of flowing well fluids are deployed and a hammer effect is created by abrupt interruption of circulating fluid while still leaving a flow channel open to reach an actuating piston for the tool. The fluid hammer effect that is created provides sufficient pressure to set the tool. The hammer effect is created with either a rapid increase in flow to close a circulation port or a dropped object on a seat that isolates a circulation port while leaving access open to an actuation piston for the tool. In the preferred embodiment the tool is a pressure set packer but other types of tools are contemplated. Those skilled in the art will more readily appreciate the details of the invention from the attached description and the associated drawings while recognizing that the full scope of the invention is to be found from the appended claims.

SUMMARY OF THE INVENTION

A circulation sub is provided that has a ball seat and a circulation port that is closed when a ball is landed on the seat. An axial passage directs the pressure surge created with the landing of the ball on the seat to the port with the actuation piston for the tool. The surge in pressure operates the actuation piston to set the tool, which is preferably a packer. In an alternative embodiment raising the circulation rate through a constriction in a circulation sub breaks a shear device and allows the restriction to shift to cover a circulation port. The pressure surge that ensues continues through the restriction to the actuating piston for the tool to set the tool.

DETAILED DESCRIPTION OF THE PREFERRED EMBODIMENT

Figure 1A:
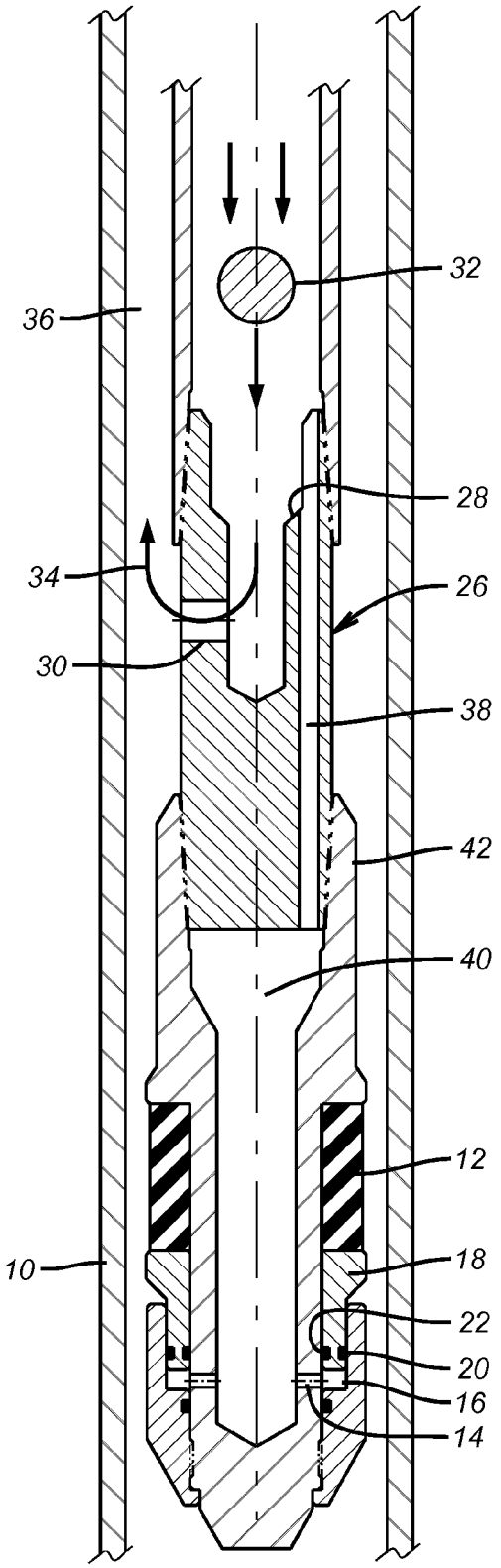
FIGS. 1*a* and 1*b* illustrate the embodiment where the seating of a ball on a seat creates the pressure wave to the tool actuation piston respectively in the run in and the set positions.
Figure 1B:
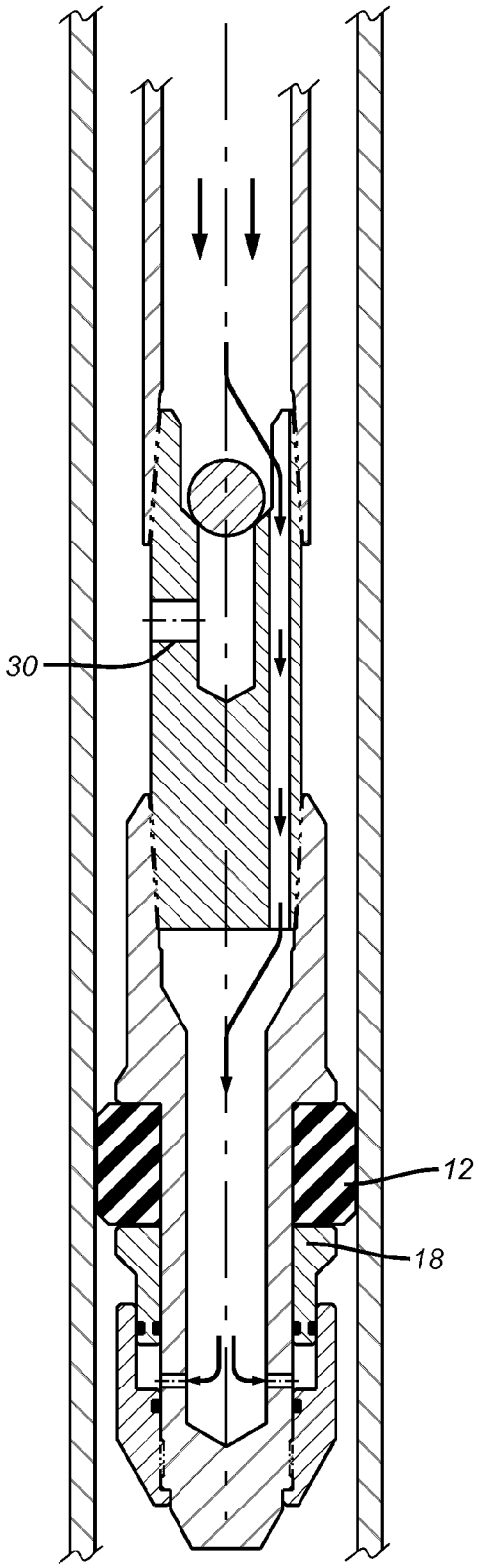

FIG. 1 illustrates a wellbore 10 in a schematic manner so that what is represented could be cased or open hole. The tool 12 is illustrated as a packer for isolation service but other tools are contemplated and item 12 is intended to be representative of any such tool or tools. Applied pressure in port 14 enters annular space 16 which is sealed by piston 18 and its outer seal 20 and inner seal 22. As shown in FIG. 1*b* axial movement of the piston 18 sets the packer 12.

Connected to the top of the packer mandrel 42 is a circulation sub 26. A ball seat 28 is located above lateral port 30 such that without ball 32 landed in seat 28 circulation, down a dedicated path to port 30, represented by arrow 34 up the annular space 36 and to the surface is possible. Axial passage 38 remains open even when ball 32 lands in seat 28. Passage 38 leads into passage 40 in mandrel 42 and down to port 14. As shown in FIG. 1*b* when the ball 32 lands on seat 28 the lateral port 30 is abruptly closed off. This creates a pressure surge akin to a water hammer effect that propagates through passage 38 into passage 40 and then to port 14 to push the piston 18 and set the packer 12.

Figure 2A:
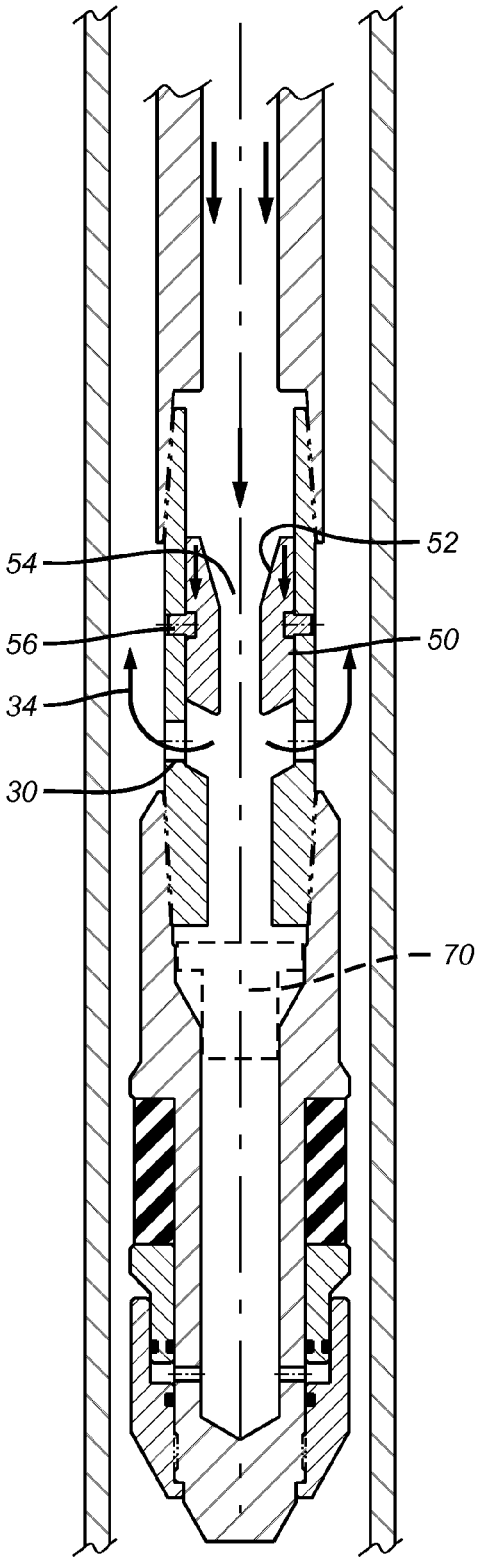
FIGS. 2*a* and 2*b* use an increase in flow to create the pressure wave to the tool actuation piston and respectively show the run in and the set positions.
Figure 2B:
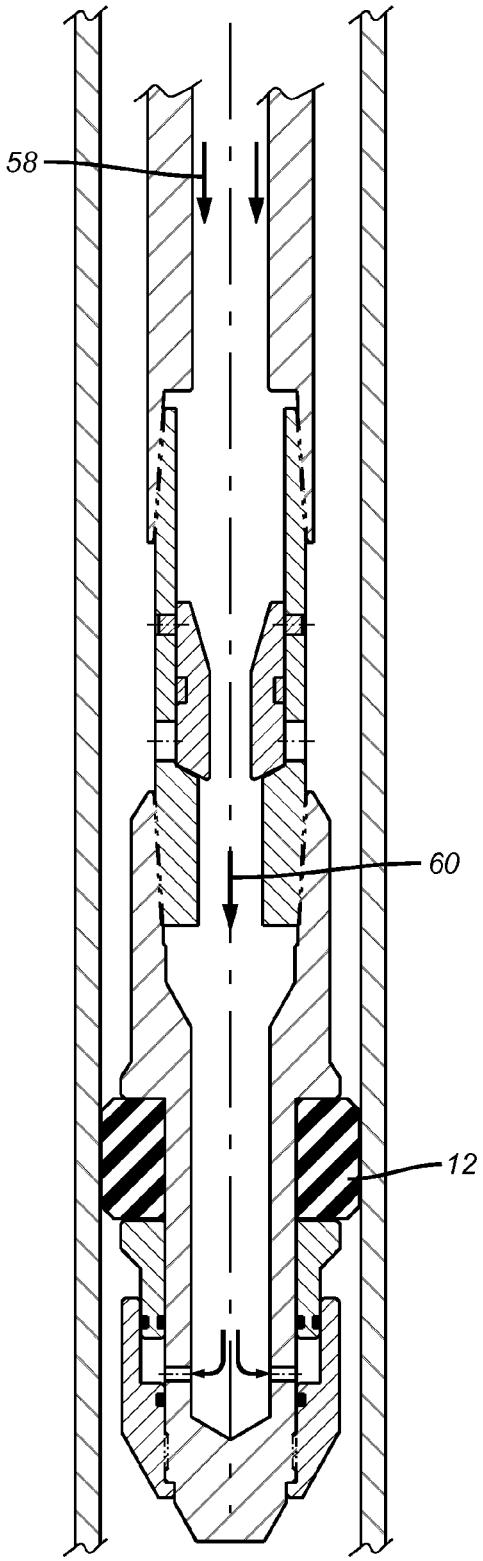

FIGS. 2*a* and 2*b* also have a lateral port 30 but instead of a ball seat as in FIG. 1 there is now in its place a sleeve 50, or upset having a taper 52 leading to a through passage 54. A shear pin 56 holds the sleeve 50 in place so that circulation represented by arrow 34 can take place. When flow is increased as represented by arrows the pressure differential across the sleeve 50 goes up to a point where the shear pin 56 breaks and the sleeve 50 shifts to close ports 30. This results in a pressure shock wave being developed as represented by arrow 60 and the packer 12 sets in the same way as described above for FIG. 1.

Figure 3A:
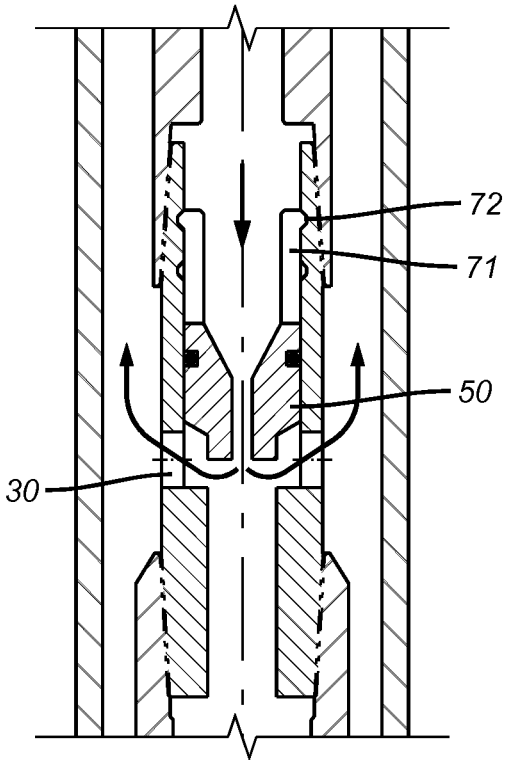
FIGS. 3*a*-3*b* are an alternative embodiment to FIGS. 2*a*-2*b* showing a collet as a retainer rather than a shear pin.
Figure 3B:
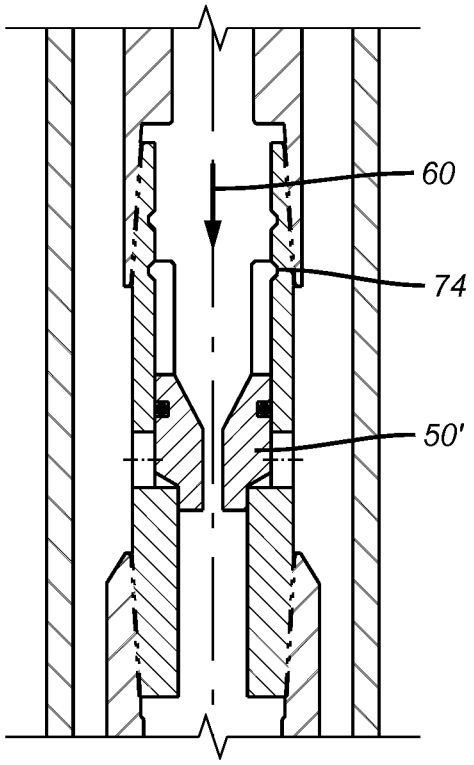

FIGS. 3*a*-3*b* show that initially the collet 71 is latched in groove 72 when the ports 30 are open and when flow is increases to increase the net force on sleeve 50, the sleeve is shifted to block ports 30 while allowing through flow to a tool such as a packer 12 for setting using the shock wave that is created. In the blocked position of ports 30 the collet 71 is latched into groove 74 as shown in FIG. 3*a*. As an alternative a snap ring can be used to latch into grooves 72 and 74. The sleeve 50 can be reset for another cycle with reverse flow in the direction opposite arrow 34 that will force up the sleeve 50 until the groove 72 is re-latched.

Figure 4A:
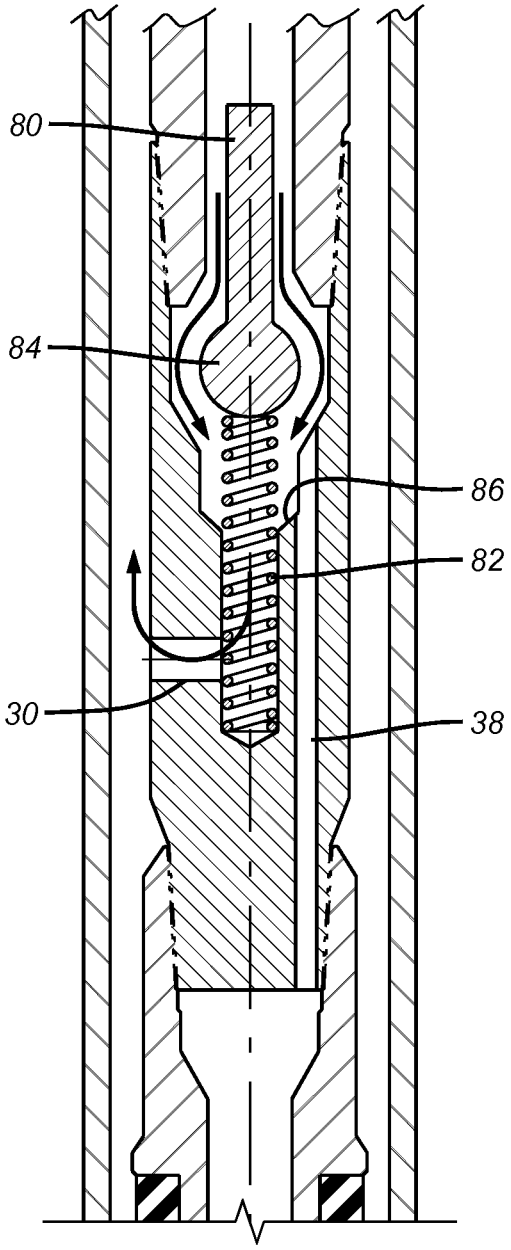
FIGS. 4*a*-4*b* are an alternative embodiment illustrating a spring loaded ball that seats with pressure to isolate a lateral port.
Figure 4B:
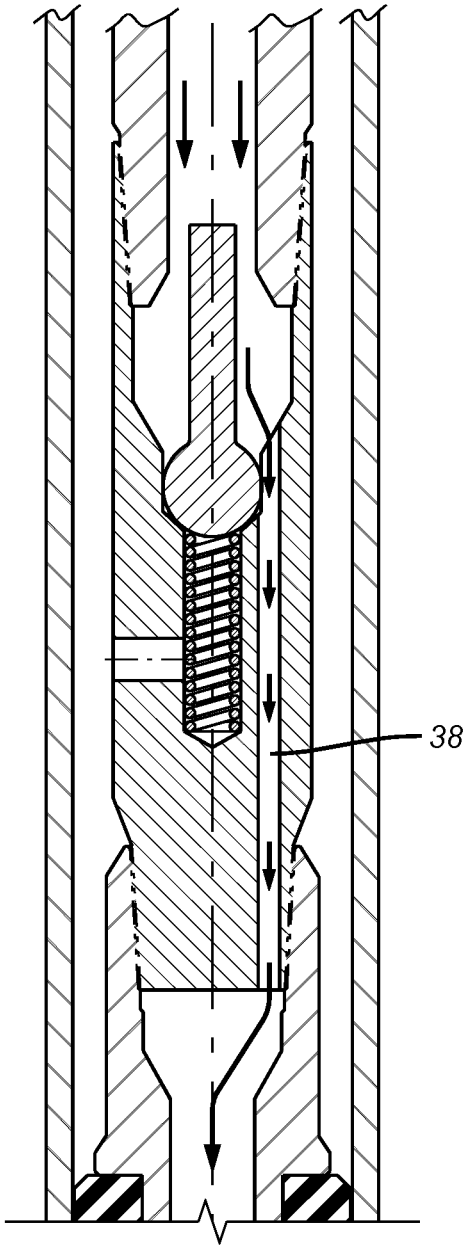

FIGS. 4*a*-4*b* are a variation of the FIGS. 1*a*-1*b* design where instead of dropping a ball 32 on a seat 28 there is an elongated member 80 biased by a spring 82 to keep ports 30 open until flow is increased to seat the ball segment 84 on seat 86 to isolate the ports 30 while leaving passage 38 open to set a tool such as a packer 12. Reducing the flow allows spring 82 to bias ball 84 away from seat 86.

Figure 5:
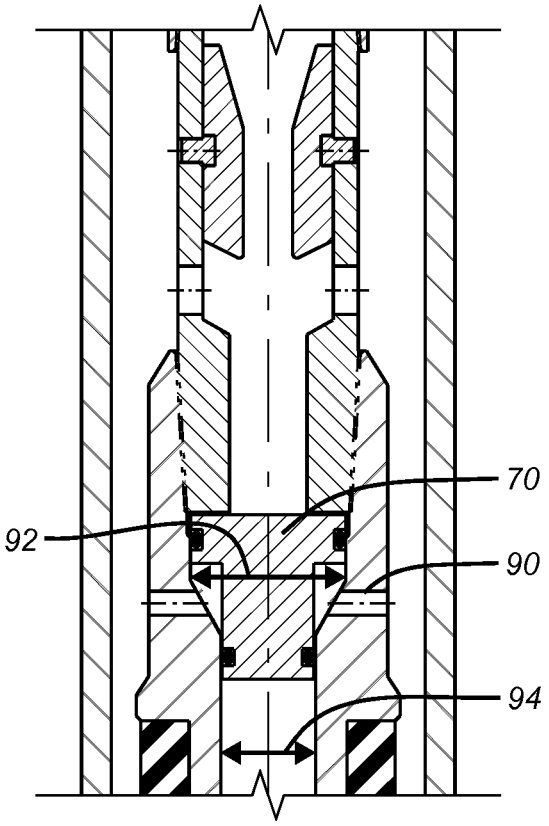
FIG. 5 is a detailed view of the boost piston shown in FIG. 2*a* showing a lateral opening to avoid liquid lock of the boost piston.

FIG. 5 shows in greater detail the boost piston 70 shown in FIG. 2*a*. It adds a vent passage 90 to allow the piston 70 to move without getting liquid locked. The boost ratio is the ration of the area of surface 92 divided by the area of surface 94. One or more pistons 70 can be connected in a variety of configurations to further enhance the boost force. Arrangements in series or parallel are contemplated.

Figure 6A:
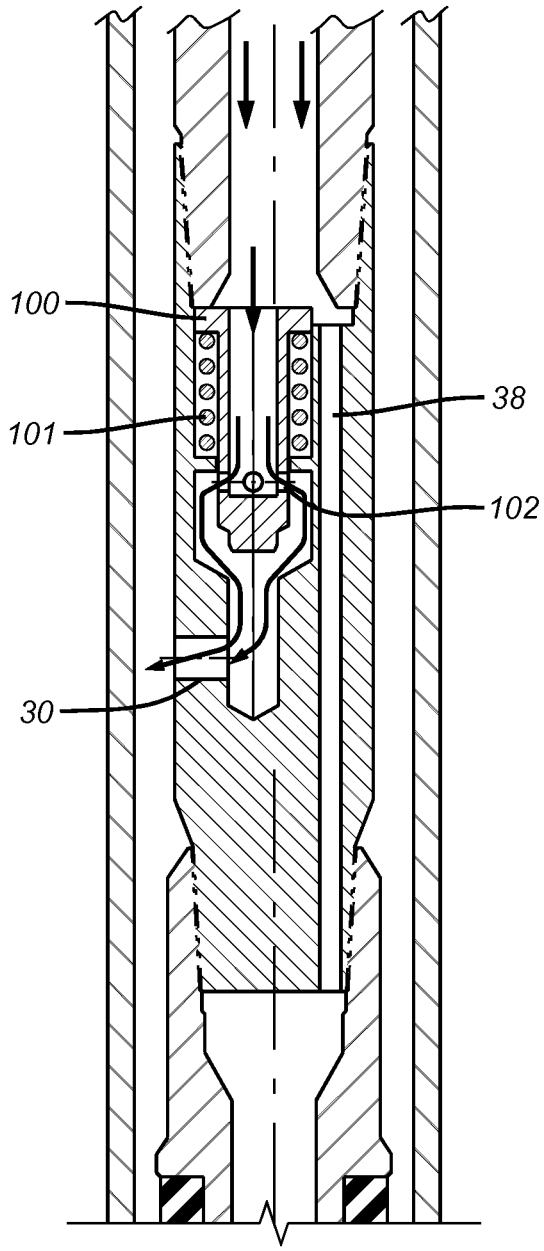
FIGS. 6*a*-6*b* are another alternative embodiment where the circulation ports are closed with a spring-loaded ported sleeve.
Figure 6B:
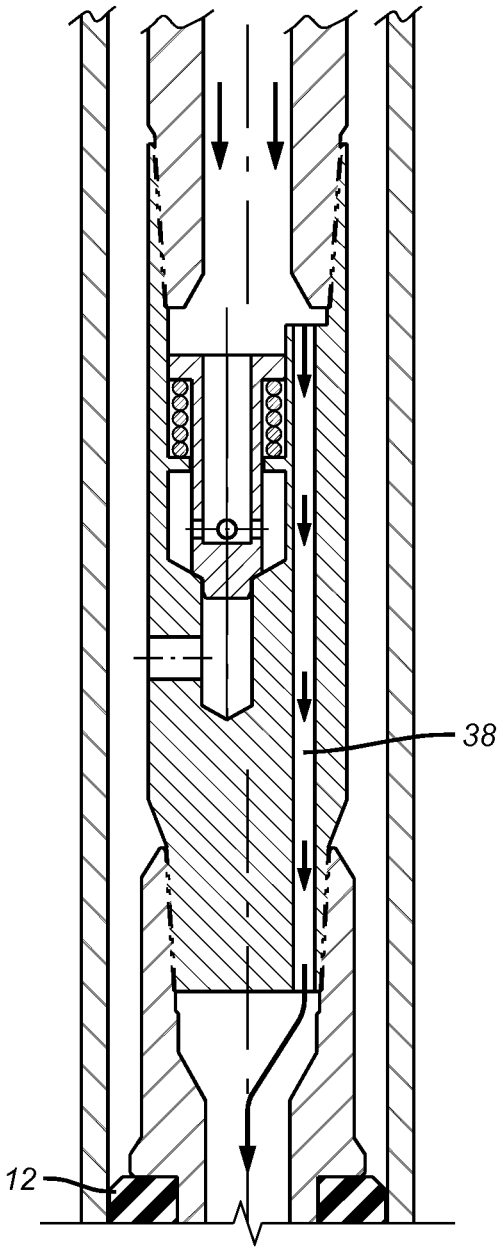

FIGS. 6*a*-6*b* are an alternative embodiment to FIGS. 1*a*-1*b* where instead of dropping a ball 32 on a seat 28 flow is increased to bias a sleeve against a spring 101 force and seat the sleeve in a manner that the ports 102 in the sleeve are isolated from the housing ports 30 while still leaving a dedicated passage 38 open to the tool such as packer 12. When flow is reduced the spring biases the ported sleeve 100 so that the openings of the ported sleeve again can communicate with the housing ports 30 which in effect resets the tool for another cycle if needed.

Those skilled in the art will appreciate that the use of the kinetic energy of the circulating fluid is employed in the different configurations described in the drawings to create a hammer effect with the resulting pressure spike being conducted to the setting port of the tool for use in setting the tool. A rupture disc can be placed in the tool port that breaks under the force of the hammer effect. The spike is over and above the static pressure delivered by the surface pumping equipment. In each case there is a single moving part, either the ball 32 or the sleeve 50. The design is simple and cheap to build and needs no seals that can be attacked by grit in the well fluids. Although a single passage 38 is shown, multiple passages can be used. The tools actuated can be anchors, fishing tools, vibratory tools, jars, spears and grapples to name a few examples.

The creation of the hammer effect can also be combined with a piston or pistons in passage 40 that multiply the hammer effect by having a larger dimension to receive the hammer effect and a smaller dimension on an opposite side so that the hammer effect can be multiplied by the ratio of the diameters of the piston on opposed sides. To do this passage 40 would have two different dimensions to accommodate the two piston diameters of this booster piston that responds to the created hammer effect. Piston 70 is shown schematically in FIG. 2*a* to illustrate this optional concept. On the other hand the intensity of the pulse can also be moderated by a relief valve, not shown, that allows flow out of the housing and into the surrounding annulus to control the extent of the hammer effect on the tool to be set. A check valve could be installed to the tubing string in the flow path upstream from the circulation sub 26 and trap the pressure spike and maintain the setting pressure for a longer period of time. The tubing string design or check valve could have internal features to allow the trapped pressure to eventually bleed off if desired. Preferably the tubing string inner diameter should be substantially constant from the location of the check valve to the circulation sub 26.

The above description is illustrative of the preferred embodiment and many modifications may be made by those skilled in the art without departing from the invention whose scope is to be determined from the literal and equivalent scope of the claims below.

We claim:

1. A pressure surge creation device for operating a subterranean tool at a predetermined subterranean location, comprising:

a housing having a through passage, the passage in fluid communication with said subterranean tool and an initially unrestricted lateral wall port;

a member deployed in said housing when said housing is at the subterranean location to rapidly close said lateral wall port while fluid communication continues through said passage to build a pressure surge through said passage for setting the tool that is in flow communication with said passage.

2. The device of claim 1, wherein:

said member comprises an object that lands on a seat to block flow through said lateral wall port.

3. The device of claim 2, wherein:

said passage remains open with said object on said seat.

4. The device of claim 3, wherein:

said seat surrounds a dedicated path that leads to said lateral wall port.

5. The device of claim 4, wherein:

said passage extends substantially parallel to said dedicated path without intersecting said dedicated path.

6. The device of claim 5, wherein:

said pressure surge passes through said passage with said lateral wall port closed to operate the tool.

7. The device of claim 2, wherein:

said object is initially supported in said housing.

8. The device of claim 7, wherein:

said object further comprises a spring loaded stem that extends through said seat and is biased by a spring away from said seat such that a predetermined flow through said housing overcomes said spring and seats said ball on said seat by overcoming said spring.

9. The device of claim 1, wherein:

a check valve in fluid communication with an inlet to said passage to trap the pressure spike and maintain the setting pressure.

10. A pressure surge creation device for operating a subterranean tool, comprising:

a housing having a through passage and a lateral wall port;

a member deployed in said housing to rapidly close said lateral wall port while fluid communication continues through said passage to build a pressure surge through said passage for setting the tool that is in flow communication with said passage;

said through passage comprises at least one boost piston located between said port and the tool that has different dimensions on opposed ends.

11. A pressure surge creation device for operating a subterranean tool, comprising:

a housing having a through passage and a lateral wall port;

a member deployed in said housing to rapidly close said lateral wall port while flow continues through said passage to build a pressure surge through said passage for setting the tool that is in flow communication with said passage;

said member comprises a sleeve in said passage.

12. The device of claim 11, wherein:

said sleeve moves responsive to an increase in flow through a restriction in said sleeve.

13. The device of claim 12, wherein:

said sleeve is retained in an initial position with said lateral wall port open until increased flow creates a predetermined pressure differential across said sleeve.

14. The device of claim 13, wherein:

said sleeve is retained with at least one shear pin.

15. The device of claim 13, further comprising:

said passage comprises at least one boost piston located between said port and the tool that has different dimensions on opposed ends.

16. The device of claim 13, wherein:

said sleeve is retained with at least one collet.

17. The device of claim 13, wherein:

said sleeve is retained with at least one spring.

18. The device of claim 13, wherein:

said sleeve resets to said initial position responsive to a flow decrease through said sleeve.

19. The device of claim 13, wherein:

said sleeve resets to said initial position responsive to flow into said lateral wall port from outside said housing.

20. A pressure surge creation device for operating a subterranean tool, comprising:

a housing having a through passage and a lateral wall port;

a member deployed in said housing to rapidly close said lateral wall port while fluid communication continues through said passage to build a pressure surge through said passage for setting the tool that is in flow communication with said passage;

said housing supports a pressure set tool.

21. The device of claim 20, wherein:

said tool comprises a packer.

22. A pressure surge creation device for operating a subterranean tool, comprising:

a housing having a through passage and a lateral wall port;

a member deployed in said housing to rapidly close said lateral wall port while fluid communication continues through said passage to build a pressure surge through said passage for setting the tool that is in flow communication with said passage;

said passage comprises a pressure relief device to relieve passage pressure to outside said housing to regulate the intensity of the pressure surge.

* * * * *